United States Patent [19]

McAlear et al.

[11] 4,385,281

[45] May 24, 1983

[54] ELECTRICAL FUSE

[75] Inventors: Jon McAlear, Barrington Trails; Robert J. Tait, Arlington Heights, both of Ill.

[73] Assignee: Littelfuse, Inc., Des Plaines, Ill.

[21] Appl. No.: 245,265

[22] Filed: Mar. 19, 1981

[51] Int. Cl.[3] ..... H01H 85/02

[52] U.S. Cl. ..... 337/186; 337/248; 337/414

[58] Field of Search ..... 337/186, 205, 246, 247, 337/248, 414, 415

[56] References Cited

U.S. PATENT DOCUMENTS 3,218,414 11/1965 Swain et al. ..... 337/186 X 3,317,690 5/1967 Hollmann et al. ..... 337/246

3,955,167 5/1976 Kumbera ..... 337/414 X 4,282,504 8/1981 Tobin ..... 337/186

*Primary Examiner*—George Harris

*Attorney, Agent, or Firm*—Wallenstein, Wagner, Hattis, Strampel & Aubel

[57] ABSTRACT

An improved electrical fuse having axial leads and comprising a fuse wire in a cylindrical sleeve supported at its ends by lead carrying end caps is coated over the length of the fuse body by an adherent insulating layer (FIG. 4). Improved humidity resistance and mechanical strength are achieved. The necessity for plating the end caps to achieve corrosion resistance is eliminated. Control of coating thickness produces a substantially moderated profile and facilitates application of color coding bands to the coated fuse.

2 Claims, 5 Drawing Figures

PRIOR ART

ELECTRICAL FUSE

TECHNICAL FIELD

The present invention relates to an improvement in electrical fuses.

BACKGROUND OF THE PRIOR ART

Cartridge type electrical fuses having axial leads have been long known in the fuse art. The fuse element in such a fuse is typically a fusible wire centrally supported within a cylindrical sleeve forming a casing for the fuse. To insure reliable fusing it is essential that the fuse wire must not touch the interior wall of the sleeve along its length, hence, the ends of the fuse wire are supported in such a manner as to prevent such contact. External lead carrying end caps having solder therein are used to capture the fuse wire ends folded over the outside of the sleeve ends. Final mechanical assembly consists of press fitting the end caps over the folded-over ends of the fuse wire followed by momentary heating of the solder to obtain good electrical connection between the fuse wire and the end caps. Since the fuse casing formed by the sleeve must form an insulated body, typically made of ceramic or glass, which cannot be solder bonded, the only substantial opposition to the separation of the end caps from the sleeve is derived from the pressure fitting of the end caps over the outer surface of the sleeve. Thus, such fuse structures are generally weak in tension, and are prone to mechanical failure on a pull test applied to the end leads. The alternative construction is to solder bond the end caps to the sleeve ends, which requires an expensive local outer metallization of the sleeve ends. Such structures are prone to humidity induced corrosion problems because of the exposed metal end caps and the lack of any hermetic sealing thereof.

One prior art partial solution to the abovementioned problems comprises the application of a length of heat-shrinkable plastic tubing tightly heat shrunk over the sleeve and end caps, the tubing overlapping, although loosely, the inner end of the leads extending outwardly from the end caps. The heat shrunk tubing provides some improvement in fuse strength and provides a moderately good sealing for the fuse interior. A disadvantage of this construction is that the cap ends are exposed to the external ambient conditions, owing to the fact that the limited shrinkage capability of the tubing prevents a desired end cap sealing engagement of the heat shrunk tubing with the leads. Thus, it is still necessary to plate the end caps to secure adequate corrosion resistance for these elements. One of the objects of this invention is to eliminate the necessity of anticorrosion plating of the end caps.

The resulting structure is still not adequately strong, in that a moderate pull on the leads can still shift the end caps to break the fuse wire. A further object of this invention is to improve the structural strength of the fused structure, particularly with respect to lead pull.

Additionally, in small fuses of the order of eight millimeter length or less, the end caps typically are of significantly larger diameter than the fuse sleeve. Since heat shrink tubing closely follows the outer contours of the fuse structure, a marked step in the fuse profile remains in the region of the end cap to sleeve junction. In fuses of small length, color coding bands indicating the fuse characteristics must necessarily be disposed along substantially the entire length of the fuse structure to be distinctly visible. This in turn typically necessitates that one or more of the coding bands must overlie a step. In practice this proves to be uneconomical if conventional color wheels are used to apply the bands, since very erratic striping results in the vicinity of the step, leading in turn to unacceptably low production yields.

One not completely satisfactory solution to this problem has been to print the fuse amperage in alphanumeric characters on the fuse body and to use clear transparent shrink tubing through which such indicia can be read. In the case of very small fuses, such numbers are difficult to read with the naked eye. A further object of this invention is to provide a fuse that can be inexpensively and reliably coded on the outside thereof by means of readily visible color bands.

BRIEF SUMMARY OF INVENTION

According to a feature of the most preferred of the invention, a ceramic (or the like) casing-forming sleeve, the end caps, and the adjacent portions of the power leads extending therefrom as above described are coated with a high bond strength insulating material, as, for example, an epoxy material. The bonded insulating coating covers and strongly anchors the end caps to the casing-forming sleeve, resulting in improved structural strength of the fuse and improved handling properties for subsequent processing in manufacturing. By covering the end caps completely, the necessity for plating the end caps is removed, and the resistance to humidity is substantially increased, owing to improved hermetic sealing. The fuse so produced is cheaper to manufacture, mechanically stronger, and environmentally better protected. While a similar epoxy material has been applied over prior art resistors and capacitors with coded color bands applied thereto, such a material has not heretofore been applied to fuses.

According to another feature of the invention, the high bond strength coating is one which readily accepts color coding ink and is applied in such a manner as to smooth the contours of the fuse body, resulting in an exterior surface of roughly cylindrical geometry without abrupt changes in diameter, thereby allowing easily read conventional color coding bands to be applied by inexpensive conventional means to the end cap regions and adjacent areas thereof. Such a moderated profile of the epoxy coating is also found in prior art resistors and capacitors, but has not been applied to fuses.

Other objects, advantages, and features of the invention will become apparent upon making reference to the description to follow, the drawings, and the claims.

DETAILED DESCRIPTION OF INVENTION

Figure 1:
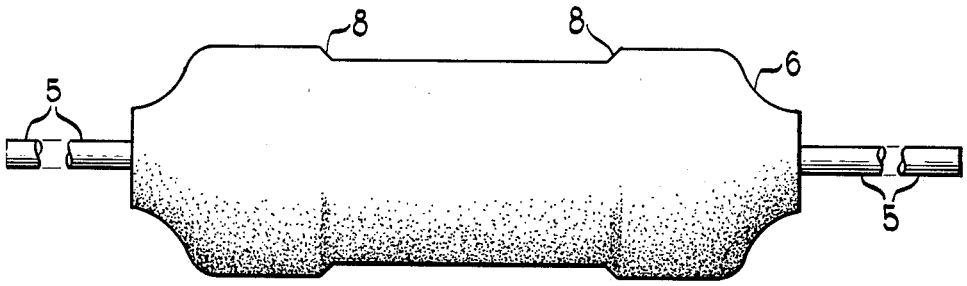
Fig 1 PRIOR ART
FIG. 1 is an elevational view of a conventional axial lead fuse encapsulated in a heat shrunk tubing.
Figure 2:
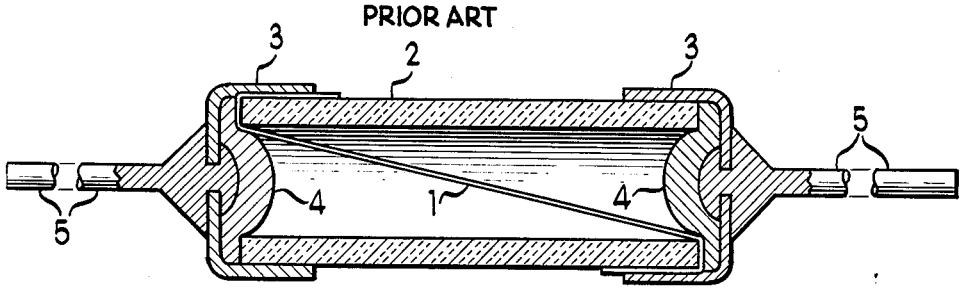
Fig 2 PRIOR ART
FIG. 2 is a partially longitudinal sectional view of the fuse of FIG. 1 before the shrink tubing has been applied.
Figure 3:
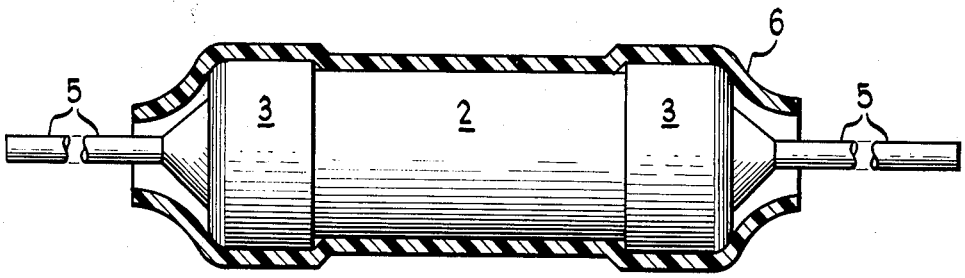
FIG. 3 is a partially longitudinal sectional view of the fuse of FIG. 1 showing the partial sealing action of the heat shrunk tubing.

Referring to the prior art fuse of FIGS. 1-3, a length of fuse wire 1 is held captive at the ends of an initially open ended cylindrical sleeve 2 by means of a pair of cup-shaped end caps 3—3 having cylindrical interior recesses receiving the ends of the sleeve 2 with a pressure fit. A body of solder 4 in each end cap 3 is heated to wet the fuse wire and secure it to the end caps 3—3. Shouldered connecting leads 5—5 pass through the center of the caps 3—3 and are secured by staking prior to assembly of the fuse structure.

FIG. 3 shows the sealing action of the heat shrunk tubing 6 over the sleeve, which seals the interface between the sleeve 2 and the end caps 3—3. The tubing 6 is applied by initially sliding a piece of loose-fitting tubing over the casing 2 and end caps 3—3 and heat shrinking it over the entire fuse assembly, which tensions the end caps towards each other to impart a degree of strength to the structure. The tubing, however, cannot shrink to a degree to engage the power leads 5—5, and, thus, the end caps 3—3 are exposed to the external environment, necessitating corrosion plating of the caps for protection against environmental conditions.

Figure 4:
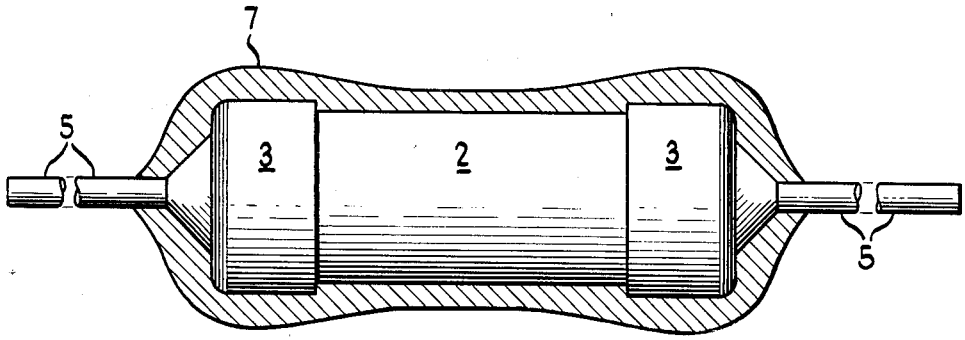
FIG. 4 is a partially cross-sectional elevation of a fuse as shown in FIG. 2 after the high bond strength coating is applied thereto.
Figure 5:
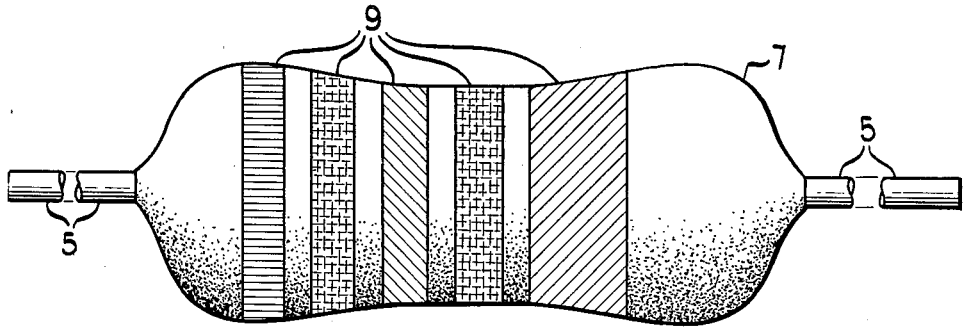
FIG. 5 is an elevational view of the fuse shown in FIG. 2, showing the disposition of color coding bands thereon.

FIGS. 4 and 5 show the preferred form of the invention, wherein the fuse of FIG. 2 is coated with a high-bond strength epoxy material or the like to achieve improved structural strength and a complete sealing of the sleeve 2 and end caps 3—3 against the adverse affects of moisture. In the preferred form of the invention the coating is formed by applying a heat-activated epoxy powder cascaded onto the fuse structure of FIG. 2 while the fuse is rotated about the axis of the power leads 5—5, as has been carried out for prior art resistors and capacitors. The coating is most advantageously effected by preheating the fuse to a temperature above the fusing temperature of the powder, typically in the range of 200° to 220° Fahrenheit, and below the melting point of the cap solder 4—4. The application of the powder is done in a relatively cool environment, the necessary heat being supplied by the heat stored in the fuse parts during a pre-heat process immediately before moving the fuse below a source of powder. The powder fuses as it strikes the surface of the fuse, building up to a maximum thickness set by the heat capacity and temperature of the fuse parts immediately before coating operation. By keeping the surrounding area cool during the deposition process, the cascaded powder that does not strike the fuse may be recovered and recycled. By moving the fuse to a second heating stage at the same temperature as the first stage, the initial coat is re-fused, thereby insuring rough uniformity of the coating thickness. The process is repeated to apply additional coats to build up the desired coating thickness. An air-classified powder of approximately 0.005 to 0.010 inch diameter particle size is most advantageously employed in the deposition process. After an adequate final thickness is achieved, the fuse coating is given a final oven melt of 250° Fahrenheit for two to four minutes.

As a result of surface tension effects, the epoxy coating 7 (FIG. 5) does not have the sharply angled shoulders 8 (FIG. 1) characteristic of the heat shrunk tube method, and which presented a severe obstacle to reliable color band application by conventional color wheels well-known to the art. Thus, the fuse structure shown in FIG. 5 has a moderated exterior contour adequately suited to such color banding techniques. Color bands 9 in FIG. 5 are the color coding bands applied to the body of the fuse by conventional color wheel application techniques. In the appended claims the term "moderated" as applied to the exterior contour or profile shall be construed to refer to the absence of such sharply angled shoulders.

The resulting structure is substantially hermetically sealed and, thus, requires no plating of the end caps 3 (FIGS. 3 and 4) for corrosion protection, thus resulting in a cost economy in manufacture.

Improved mechanical strength is evidenced by a series of tests run on a group of 50 fuses from a common lot. Overall length from cap to cap, measured from the outer faces was 0.220 inches. Outer sleeve diameter was 0.056 inches. A group of 25 fuses was sealed by conventional heat shrunk tubing, yielding an outer diameter over the caps of nominally 0.093 inches. A second group of 25 fuses was coated by the method described herein to a nominal overall diameter of 0.098 inches. Both groups were subjected to destructive failure testing by increasing tension on the leads. The sleeve units all failed by cap pull-off of at a mean applied force of 16.4 pounds, with standard deviation of 1.9 pounds. The coated fuses failed at a mean of 19.0 pounds with standard deviation of 0.5 pounds. A significant increase in mechanical strength is thus achieved. Moreover, all failures of the coated units were from lead wire breaks, implying that the true strength of the coated structure was in excess of the numbers quoted above.

While for the purposes of illustration, various forms of this invention have been disclosed, other forms thereof may become apparent to those skilled in the art upon reference to this disclosure and, therefore, this invention shall be limited only by the scope of the appended claims.

We claim:

1. An improved electrical fuse comprising:

an oppositely open ended insulating housing in the form of a cylindrical sleeve;

a fusible element disposed within said housing;

a pair of end cap means closing the ends of said sleeve, securing the ends of said fusible element and making electrical contact thereto, each of said cap means being cup-shaped to provide a cylindrical recess to accommodate an end of said sleeve and having an external lead connected thereto and extending outwardly therefrom for making external electrical connection to said fusible element; each of said cap means containing a quantity of solder fused to make electrical contact between said end cap means and said ends of said fusible element, said fusible element extending diagonally across the length of said sleeve housing and having a portion of each of its ends exiting the open ends of said sleeve and folded back over a portion of the external surface of said sleeve to be located between the sleeve ends and the end cap means;

an adherent insulating coating layer disposed over said sleeve end cap means and leads to cover, seal, and physically interconnect the exposed exterior surfaces of said sleeve, said pair of end cap means, and a portion of each of said leads adjacent to said pair of end cap means, the thickness of said coating layer being adjusted to provide a step-free outer profile over the length of said sleeve and said end cap means; and color coded bands applied to said coating layer so that at least one of said bands overlies at the least one of said end cap means.

2. The fuse of claim 1 wherein said coating layer is an epoxy resin.

* * * * *